US006002368A

United States Patent [19]

Faraone et al.

[11] Patent Number: 6,002,368

[45] Date of Patent: Dec. 14, 1999

[54] MULTI-MODE PASS-BAND PLANAR ANTENNA

[75] Inventors: Antonio Faraone; Quirino Balzano, both of Plantation, Fla.

[73] Assignee: Motorola, Inc., Schaumburg, Ill.

[21] Appl. No.: 08/896,317

[22] Filed: Jun. 24, 1997

[51] Int. Cl.[6] ..... H01Q 1/38

[52] U.S. Cl. ..... 343/700 MS; 343/829

[58] Field of Search ..... 343/700 MS, 819, 343/829, 846, 853; H01Q 1/24, 1/38

[56] References Cited

U.S. PATENT DOCUMENTS

| | | | |
|---|---|---|---|
| 4,755,821 | 7/1988 | Itoh et al. | 343/700 |
| 4,893,129 | 1/1990 | Kodera et al. | 343/700 MS |
| 5,008,681 | 4/1991 | Cavallaro et al. | 343/819 |
| 5,128,755 | 7/1992 | Fancher et al. | 358/108 |
| 5,497,164 | 3/1996 | Croq | 343/700 MS |
| 5,572,222 | 11/1996 | Mailandt et al. | 343/700 |
| 5,818,391 | 10/1998 | Lee | 343/700 MS |

FOREIGN PATENT DOCUMENTS

| | | | |
|---|---|---|---|
| 2068877 | 6/1981 | United Kingdom | 343/700 MS |

OTHER PUBLICATIONS

Pozer, David M. "A review of Bandwidth Enhancement Techniques for Microstrip Antennas." in Microstrip Antennas, The Analysis and Design of Microstrip Antennas and Arrays, (New York, The Institute of Electrical and Electronics Engineers, 1995) pp. 157–166, TK7871.6M512. (No Month Provided).

Popovic, Branko D., Jon Schoenberg, and Zoya Basta Popovic. "Broadband Quasi–Microstrip Antenna." *IEEE Transactions on Antennas and Propogation*, vol. 43, No. 10, (Oct. 1995). pp. 1148–1152.

*Primary Examiner*—David H. Vu
*Assistant Examiner*—Tho Phan
*Attorney, Agent, or Firm*—Andrew S. Fuller

[57] ABSTRACT

An antenna (100) has a multi-mode resonating structure (110) that includes three electromagnetically coupled resonators (112, 114, 116) carried by a dielectric substrate (120). A feed system (130, 135), electromagnetically coupled to the multi-mode resonating structure (110), excites three resonating modes that operate together to produce a pass-band. Preferably, the multi-mode resonating structure (110) is formed from a wide patch radiator (112) planarly disposed between two narrow patch radiators (114, 116). The patch radiators (112, 114, 116) are simultaneously fed.

14 Claims, 2 Drawing Sheets

MULTI-MODE PASS-BAND PLANAR ANTENNA

TECHNICAL FIELD

This invention relates in general to antennas, and more particularly, to microstrip antennas.

BACKGROUND

Planar, microstrip antennas have characteristics often sought for portable communication devices, including advantages in cost, efficiency, size, and weight. However, such antennas generally have a narrow bandwidth which limits applications. Several approaches have been proposed in the art in an effort to widen the bandwidth of such structures. One such approach is described in U.S. Pat. No. 5,572,222 issued to Mailandt et al. on Nov. 5, 1996, for a Microstrip Patch Antenna Array. Here, a microstrip patch antenna is constructed using an array of spaced-apart patch radiators which are fed by an electromagnetically coupled microstrip line. Generally, with such structures, electromagnetic coupling between radiators is negligible, as it is regarded as a second-order undesired effect. Mailandt's structure is contemplated for use in fixed communication devices. For portable communication devices, size and weight considerations are paramount and such structures may not be suitable. Many other prior art approaches have similar drawbacks.

Communication signals are usually filtered using a band-pass filter or the like to remove unwanted harmonics before being sent to an antenna for transmission. Such filtering adds to the cost and complexity of a product. Planar patch antennas have been proposed that provide some band pass filtering. For example, it is known to selectively shape a radiator patch to provide narrow-band limited filtering. It is desirable to provide band pass behavior, with strong rejection of undesired side-band noise, in a cost effective manner. Planar patch antennas could provide a part of the solution if bandwidth concerns are addressed, and more effective band-pass filtering provided. Therefore, a new approach for a pass-band planar antenna is needed.

DETAILED DESCRIPTION OF THE PREFERRED EMBODIMENT

The present invention provides for an antenna, preferably of planar construction, that achieves a wide bandwidth and band-pass filtering using a resonating structure that has a particular geometry and arrangement of elements. The resonating structure supports at least three resonating modes that operate together to produce a pass-band, i.e., a continuous radiating band delimited by substantial radiated field cancellation at spaced apart cut-off frequencies. A feed system is coupled to the radiating structure to excite the resonating modes to provide a radiating band for communication signals, and to produce opposing currents that cause a destructive superposition of radiated fields at the cut-off frequencies. In the preferred embodiment, the antenna includes a grounded dielectric substrate that carries a resonating structure formed from three patch radiators of different dimensions that have substantial electromagnetic coupling. The patch radiators are preferably simultaneously fed by an electromagnetically coupled microstrip line.

Figure 1:
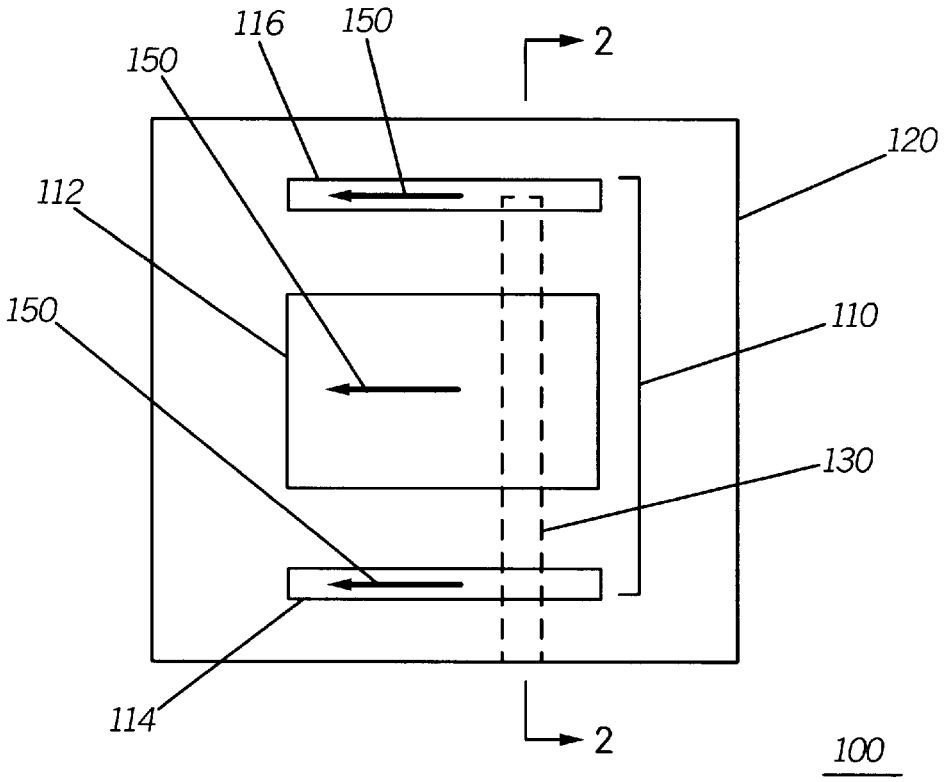
FIG. 1 is a top plan view of a planar pass-band antenna, in accordance with the present invention.
Figure 2:
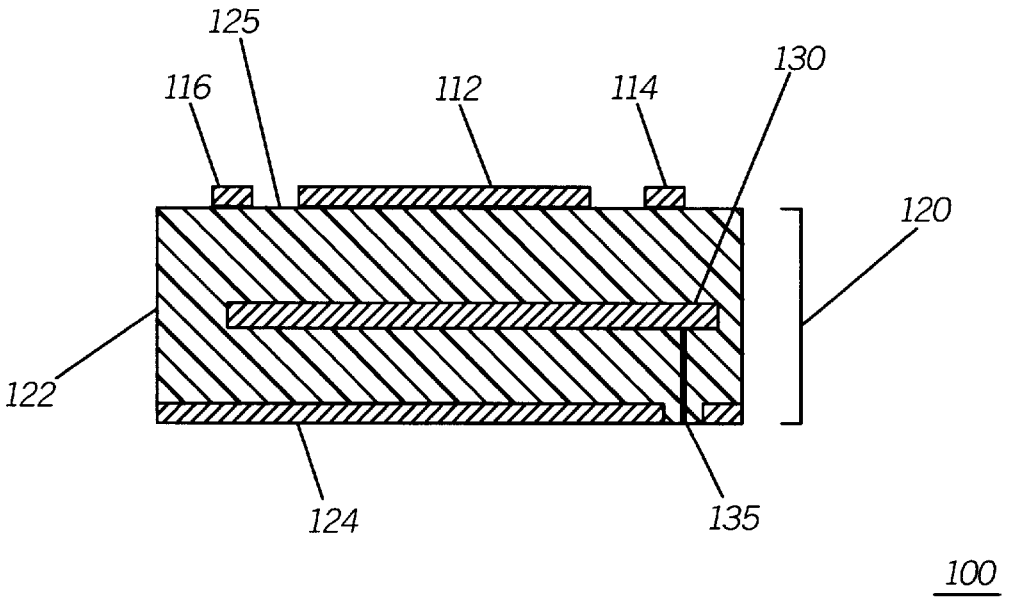
FIG. 2 is a cross-sectional view of the antenna of FIG. 1.

FIG. 1 is a top plan view of a planar pass-band antenna 100, in accordance with the present invention. FIG. 2 is a cross-sectional view of the antenna 100. Referring to FIGS. 1 and 2, the antenna 100 includes a grounded dielectric substrate 120, a radiating structure 110 carried or supported by the substrate 120, and a feed system 130, 135. The dielectric substrate 120 is formed by a layer of dielectric material 122, and a layer of conductive material 124 that functions as a ground plane. In the preferred embodiment, alumina substrate is used as the dielectric material, which has a dielectric constant of approximately ten (10). The feed system 130, 135 includes a buried microstrip line 130, disposed between the ground plane 124 and the radiating structure 110. A coaxial feed 135 is coupled to the microstrip line 130 to provide a conduit for communication signals.

In the exemplary embodiment, the radiating structure 110 includes three separate planarly disposed patch radiators 112, 114, 116 that resonate, when properly excited by a feed signal. The patch radiators 112, 114, 116 are preferably rectangular in geometry, having a length measured in a direction of wave propagation 150, which is referred to herein as the "resonating length," and a width measured perpendicular to the direction of wave propagation 150. The patch radiators form a multi-mode resonating structure in which three fundamental resonating modes are presented within a particular operating frequency band. A primary radiator 112 is formed using a wide elongated planar microstrip printed at the air-dielectric interface 125 of the grounded dielectric substrate 120. Two secondary radiators 114, 116 are formed from narrow elongated planar microstrips printed at the air-dielectric interface 125 parallel to, and on opposing sides of the primary radiator 112. Preferably, the narrow patch radiators 114, 116 have respective widths that differ from that of the wide patch radiator 112 by at least 50 percent. The patch radiators 112, 114, 116 may also have differences in length, measured in the direction of wave propagation, for tuning purposes. The dimensions and placement of the patch radiator are significant aspects of the present invention. The patch radiators 112, 114, 116 are placed such that there is a strong electromagnetic coupling between them. The difference in width between the primary patch radiator 112 and the secondary patch radiators 114, 116, provide for distinct resonating modes with different phase velocities, and thus different resonance frequencies.

In the preferred embodiment, the microstrip line 130 traverses under one of the narrow patch radiators 114, and the wide patch radiator 112, and terminates at or near another of the narrow patch radiators 116. The microstrip line 130 provides a signal that simultaneously excites the fundamental resonating modes of the radiating structure 110.

Adjacent resonating structures 112, 114, 116 are dimensioned to have distinct fundamental resonating modes at frequencies that are close together, preferably within ten percent of each other. The result is an enhancement to the overall operational bandwidth for the antenna. The microstrip feed is positioned to apply a different excitation to at least two of the patch radiators at or about two frequencies that delimit the pass-band. These two frequencies are referred to herein as "cut-off frequencies." The overall excitation creates a superposition of the three resonating modes which operate together to produce a pass band delimited by the cut-off frequencies. Between the cut-off frequencies, the excitation of the resonating modes results in a substantially constructive superposition of radiated fields from the various radiators. At the cut-off frequencies, the excitation of the resonating modes results in opposing currents in at least two radiators. The opposing current causes a substantially destructive superposition of radiated fields.

Figure 3:
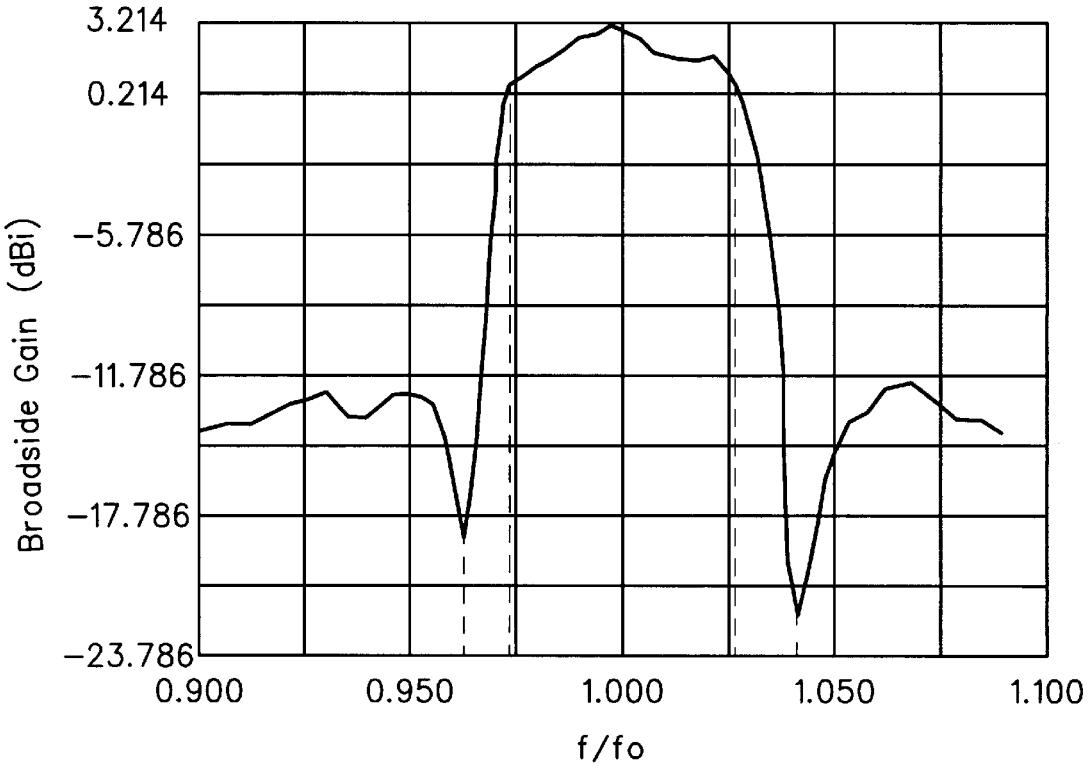
FIG. 3 is a graph showing experimental results of an antenna made in accordance with the present invention.

FIG. 3 shows a graph comparing gain versus normalized frequency for one embodiment of a pass-band antenna made in accordance with the present invention. It can be seen that a wide pass-band exists between frequencies 0.96 $f_0$ and 1.04 $f_0$, where $f_0$ is the center frequency of the pass-band. For frequencies in the range of 0.96 $f_0$ to 0.97 $f_0$ there is a sharp drop off in gain. Similarly, for frequencies in the range of 1.03 $f_0$ to 1.04 $f_0$, there is a sharp drop off in gain. This drop off in gain results from a destructive superimposition of resonating modes. Meanwhile, a constructive superimposition of resonating modes exists for frequencies ranging from 0.97 $f_0$ to 1.03 $f_0$, resulting in substantial gain. Thus, for example, one cut-off frequency could be selected at or below 0.97 $f_0$, and another cut-off frequency could be selected at or above 1.03 $f_0$, depending on desired minimum gain for the radiating band.

The present invention provides for an antenna with a radiating structure that supports at least three fundamental resonating modes. A feed system is coupled to the radiating structure and excites the resonating modes at different frequencies to provide a radiating band. The differences between radiation fields at different portions of the radiating structure at the cut-off frequencies causes the field cancellation that delimits the pass-band. In the preferred embodiment, these differences are created by opposing radiator currents on electromagnetically coupled patch radiators generated at the cut-off frequencies. The combination of narrow and wide patch radiators, and the microstrip feed provide for a wide radiating band having a substantially sharp drop in gain versus frequency at or about the cut-off frequencies.

The principles of the present invention may be used to form a variety of antenna structures of varying configuration that yield a substantial improvement in operational bandwidth, while providing for band-pass filtering. For example, the relative positioning of wide and narrow patch radiators may be interchanged to form other useful configurations. The antenna described achieves its wide-band and filtering characteristics in a small package, which makes it suitable for use in portable communication devices that must satisfy tight constraints in size, weight, and costs. For example, in the preferred embodiment, the surface area occupied by the radiating structure is approximately 0.25 $\lambda^2$, where $\lambda$ is the wavelength of the fundamental guided mode that would be supported by a microstrip line having the same width of the main radiator. Moreover, for the dielectric material of the preferred embodiment, an antenna of appropriate bandwidth can be constructed with an overall thickness of less than $\lambda_0$ /60, where $\lambda_0$ is the free space wavelength. Such thickness is substantially less than that typically obtained for prior art antennas having a similar bandwidth.

What is claimed is:

1. An antenna having a pass-band delimited by first and second frequencies, comprising:

a dielectric substrate;

first, second, and third resonator structures that have substantial electromagnetic coupling to each other and that are supported by the substrate, the first, second, and third resonator structures forming a multi-mode resonating structure; and a microstrip line carried by the substrate, and simultaneously electromagnetically coupled to the first, second, and third resonator structures, the microstrip line being operable to excite, within the multi-mode resonating structure, three resonating modes that operate together to produce the pass-band.

2. The antenna of claim 1, further comprising a ground plane carried by the substrate, wherein:

the first, second, and third resonator structures comprise first, second, and third patch radiators, respectively; and the microstrip line is embedded within the dielectric substrate between the ground plane and the first, second, and third patch radiators, and is electromagnetically coupled to the first, second, and third patch radiators.

3. The antenna of claim 2, wherein the first and second patch radiators have a substantial difference in width measured in a direction perpendicular to wave propagation.

4. The antenna of claim 2, wherein the first, second, and third patch radiators are arranged in sequence along a particular direction, and the second patch radiator has a substantially greater width than that of the first and third patch radiators.

5. The antenna of claim 1, wherein:

the first, second, and third resonator structures comprise first, second, and third patch radiators, respectively; and the first, second, and third patch radiators are arranged in sequence along a particular direction, and the second patch radiator has a width that differs from that of the first and third patch radiators by at least 50 percent.

6. An antenna operable in a operating frequency band delimited by first and second frequencies, comprising:

a grounded dielectric substrate;

three resonating structures that are supported by the substrate, and that have substantial electromagnetic coupling to each other to form a radiating structure operable to generate three resonating modes;

a feed system coupled to the three resonating structures, which feed system is operable to provide a signal to simultaneously excite three resonating modes to produce opposing currents on at least two of the three resonating structures at first and second frequencies, the opposing currents causing a destructive superposition of radiated fields.

7. The antenna of claim 6, wherein the three resonator structures comprise a first, second, and third patch radiators disposed in sequence in a particular direction, such that the first and third patch radiators are disposed on opposing sides of the second patch radiator, the second patch radiator having a width, measured in the particular direction, substantially greater than that of the first and third patch radiators.

8. The antenna of claim 7, wherein the feed system comprises a microstrip line embedded within the dielectric substrate beneath, and electromagnetically coupled to the first, second, and third patch radiators.

9. A pass-band antenna comprising a grounded dielectric substrate carrying three resonator structures that have substantial electromagnetic coupling to each other, and that are simultaneously fed to excite three resonating modes that operate together to produce a continuous radiating band delimited by substantial radiated field cancellation at first and second frequencies.

10. The pass-band antenna of claim 9, wherein the three resonator structures comprise three patch radiators that are arranged and fed to produce opposing currents on at least two of the three patch radiators at the first and second frequencies, the opposing currents causing substantial radiated field cancellation.

11. The pass-band antenna of claim 9, wherein the three resonator structures comprise first, second, and third patch radiators arranged sequentially in a particular direction, and having first, second, and third widths, respectively, measured in the particular direction, the first and third widths being at most 50 percent of the second width.

12. The pass-band antenna of claim 11, further comprising a buried microstrip line carried by the substrate, the microstrip line being electromagnetically coupled to the first, second, and third patch radiators to provide a feed system.

13. An antenna, comprising a radiating structure that supports at least three distinct radiating modes, and a feed system coupled to the radiating structure that excites the at least three distinct radiating modes at different frequencies to provide a radiating band characterized by first and second cut-off frequencies.

14. A planar antenna operable in a operating frequency band defined by first and second frequencies, comprising:

a grounded dielectric substrate;

a first, second, and third microstrip patches, having substantial electromagnetic coupling therebetween, and disposed sequentially on the substrate in a particular direction, the first, second, and third microstrip patches having first, second, and third widths, respectively, measured in the particular direction, the first and third widths being at most 30 percent of the second width; and a microstrip line, embedded within the substrate and electromagnetically coupled to the first, second, and third microstrip patches, the microstrip line providing a feed to simultaneously excite first, second, and third resonating modes that produce current flowing in opposite direction on at least two of the first, second, and third microstrip patches, at first and second frequencies.

* * * * *